United States Patent [19]

Stachowiak

[11] Patent Number: 4,858,828

[45] Date of Patent: Aug. 22, 1989

[54] MULTI-GUN CONTROL VALVE

[76] Inventor: J. Edward Stachowiak, 12628 Broken Bough, Houston, Tex. 77024

[21] Appl. No.: 907,502

[22] Filed: Sep. 15, 1986

[51] Int. Cl.[4] ..... B05B 15/00

[52] U.S. Cl. ..... 239/76; 239/126; 239/446

[58] Field of Search ..... 239/76, 124, 126, 443–447, 239/570; 137/881

[56] References Cited

U.S. PATENT DOCUMENTS

| | | | |
|---|---|---|---|
| 2,793,075 | 5/1957 | Gulick, Jr. | 239/126 |
| 3,375,980 | 4/1968 | Hinrichs | 239/411 |
| 3,592,222 | 7/1971 | Goss et al. | 137/467 |
| 3,601,154 | 8/1971 | Demler, Jr. | 137/881 |
| 3,662,761 | 5/1972 | Hoffman | 137/881 |
| 3,765,607 | 10/1973 | Pacht | 239/124 |
| 3,802,628 | 4/1974 | Goss et al. | 239/302 |
| 3,831,845 | 8/1974 | Pacht | 239/76 |
| 3,834,621 | 9/1974 | Pacht et al. | 239/76 |
| 3,977,603 | 8/1976 | Magee, Jr. | 239/76 |
| 4,602,740 | 7/1986 | Stachowiak | 239/124 |

OTHER PUBLICATIONS

NLB Corp. MG 800 Multi-Gun Flow Valve Operation & Maintenance Manual.

Jetstream Parts Manual for Partek/Butterworth Water Blast Units, p. 24.

*Primary Examiner*—Andres Kashnikow

*Assistant Examiner*—Michael J. Forman

*Attorney, Agent, or Firm*—Arnold, White & Durkee

[57] ABSTRACT

A multi-gun control valve apparatus for use in controlling a high pressure fluid in a multiple dump-style gun fluid blast system, the apparatus including a valve cartridge assembly, with a pressure throttling member and an adjusting assembly. The apparatus maintains system pressure when any of the guns are dumping fluid rather than blasting. The adjusting assembly includes a spring-biased plunger to bias the valve closure member into a partially closed or throttling position when a gun is dumping, thereby causing a pressure drop across the closure member. The adjusting assembly is used to manually adjust the clearance between the valve closure member and valve seat while the system is under pressure. High fluid pressure in the fluid line between a dump-style fluid blast gun and the multi-gun control valve opposes the spring-biased plunger and opens the valve closure member to provide free flow through the device when a gun is blasting fluid.

9 Claims, 4 Drawing Sheets

Fig. 3A
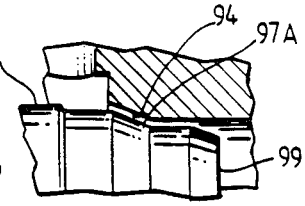
Fig. 3
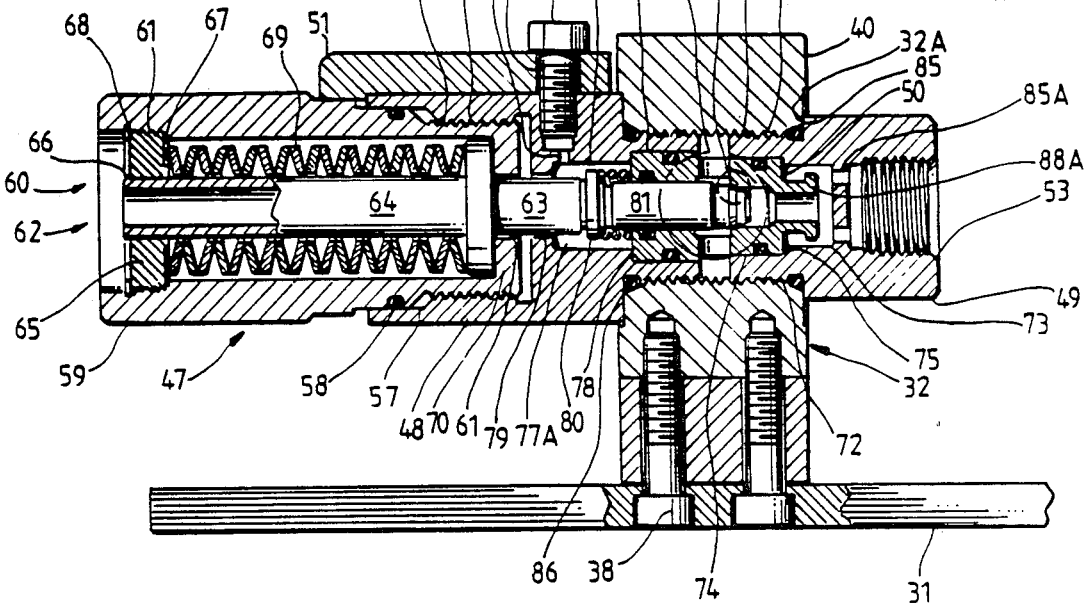
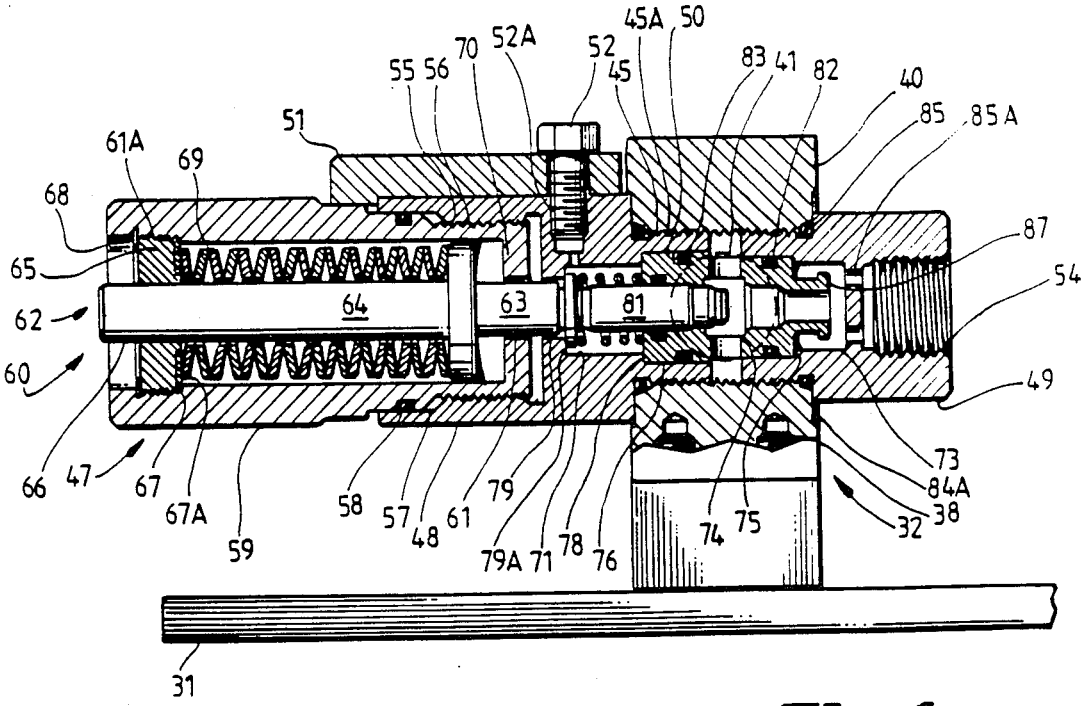
Fig. 4

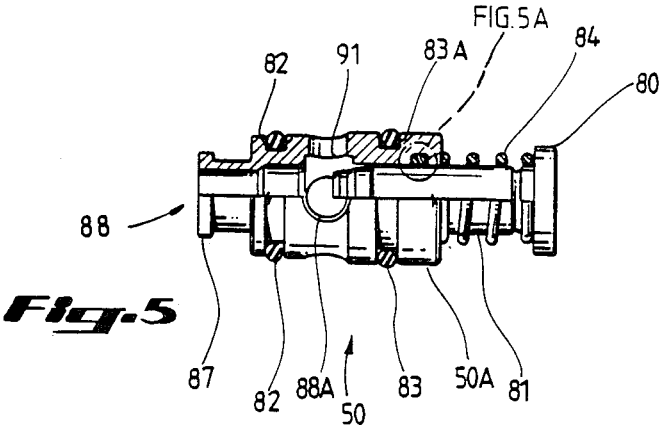
Fig.5
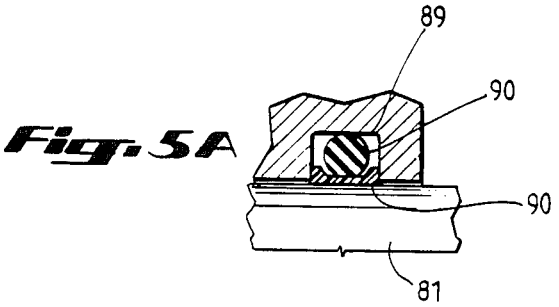
Fig.5A
Fig.6
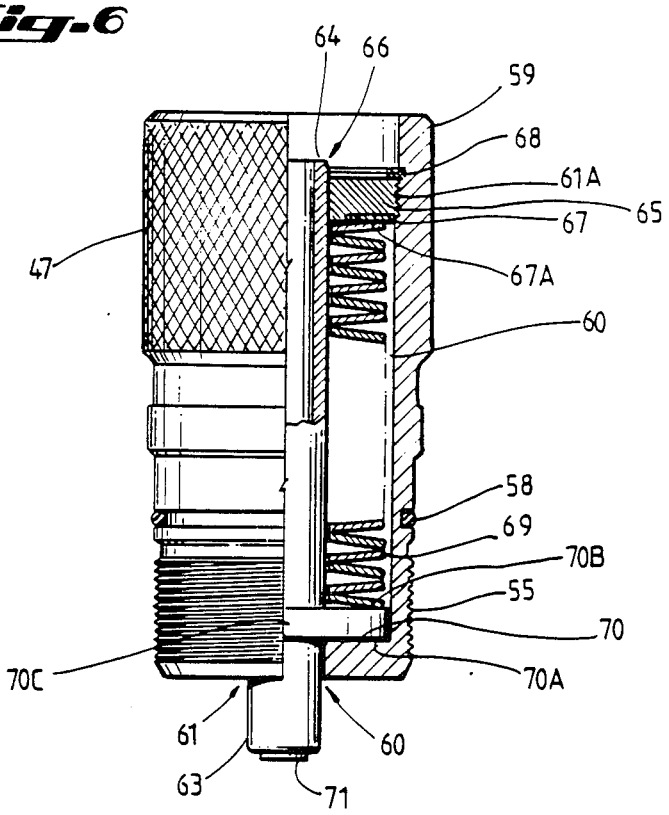

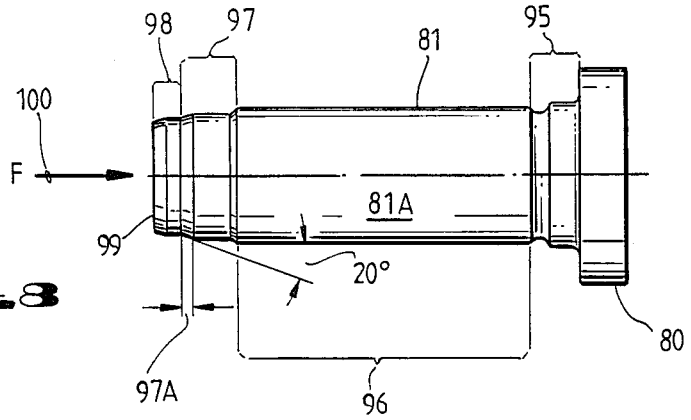
Fig. 8
Fig. 7
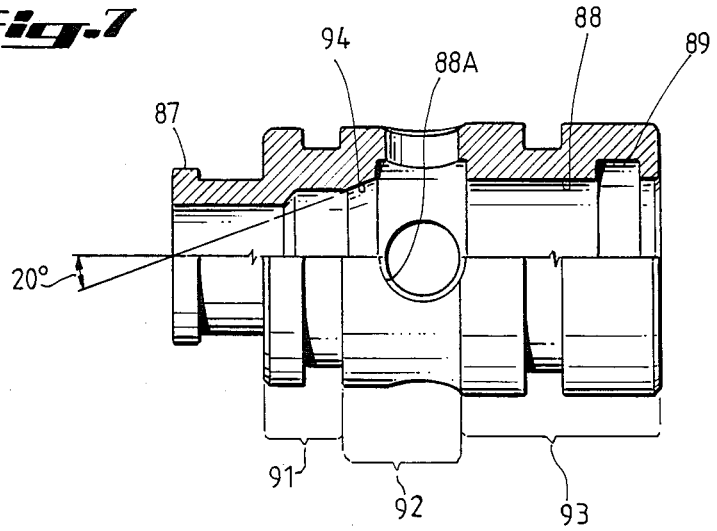

MULTI-GUN CONTROL VALVE

FIELD OF THE INVENTION

The present invention relates generally as indicated to control valves and systems for pressurized fluids. More particularly, this invention relates to a high pressure fluid control system for maintaining high fluid pressure to multiple independently operated fluid blast dump style guns receiving fluid from a single fluid blast pump, and to components for use in such fluid control apparatus.

BACKGROUND OF THE INVENTION

In fluid blast equipment for industrial cleaning, high pressure fluid blast guns are supplied by a high pressure fluid blast pump. Such high pressure fluid blast guns are used for cleaning and removing unwanted deposits or coatings off various types of surfaces and for cleaning interior surfaces of tubes. High pressure fluid streams used in cleaning applications are provided with pressures in excess of 5,000 p.s.i. typically at pressures of 10,000 p.s.i. A fluid blast gun is typically provided with a high pressure nozzle. Water is generally used as the blasting medium. Frequently, for economic reasons, it is desired to connect more than one fluid blast gun to a single fluid blast pump. In this configuration each gun is operated independently either at extremely high fluid pressure or, when discharge of high pressure fluid is to be discontinued, at low pressure with the water flowing through a dump outlet in the blast gun's control valve.

Heretofore, a problem has arisen in a multiple blast gun configuration when one operator of one fluid blast gun has stopped blasting as other fluid blast gun operators continue. When one operator stops blasting, the fluid from his gun is dumped at low pressure from the gun's dump nozzle as described in detail in U.S. Pat. No. 4,602,740. When dumping from the gun's dump nozzle at low pressure occurs, fluid pressure in the system for the other guns becomes insufficient for blasting. Therefore, various attempts have been made to maintain blasting pressure at all fluid blasting guns while one gun is dumping at low pressure. These include complicated multi-operator style guns that incorporate an internal orifice with an internal valving means to stop the water flow to the gun's blast nozzle and divert it through the orifice, they also include separate control valves that incorporate internal orifices or require difficult field wrench adjustments to be made on them.

Examples of devices designed to maintain blasting pressure at all fluid blasting guns while one gun is dumping are the Goss Hydraulic Gun system, U.S. Pat. No. 3,802,628, and the Pacht Fluid Delivery system, U.S. Pat. No. 3,831,845. The Goss patent depicts a multi-operator gun that requires critical adjustments to be made to the internal valve actuating means and also an internal orifice to be installed in the gun that hydraulically matches the blasting nozzle or orifice in the gun. These types of guns are expensive, difficult to maintain and require the operator to have a number of internal orifices on hand that hydraulically match any blasting nozzles he may use in the field. The Pacht device provides a more convenient system of maintaining blasting pressure at all blasting guns because it is a device that is used in conjunction with the more commonly used single-operator dump style guns and it can be installed in the blasting system only when multi-gun blasting off of one blasting pump is desired. However, the Pacht system again requires the use of a specially sized orifice in its valve system member that is the hydraulic equivalent to the blasting nozzle or, in another version, it requires a difficult wrench adjustment to be made to the device's valve seat. This valve seat adjustment is difficult because the seat must be turned against full system pressure (10,000 p.s.i.) and this usually requires two adjusting personnel. Also, the seating configuration on the valve system and the corresponding valve seat on this device makes the field adjustment of the valve seat very sensitive and exacting. If the seat is adjusted too close to the valve stem a dangerous system overpressure condition can occur.

Still other prior art control valves that are designed to be used in conjunction with commonly used single operator dump style guns utilize an internal valving system to divert the high pressure water through an internal orifice when the operator's gun is dumping. These devices also require the internal orifice in the control valve, therefore, when the operator changes the size of his blast nozzle, he must also disassemble the control valve, install the correct internal orifice and reassemble the control valve. Frequently, because he often uses multiple-orifice nozzles such as those used for cleaning the internal surfaces of tubes, he does not know the correct size of the internal orifice required in the control valve and must arrive at its correct size on a trial and error basis. This means that he must depressurize the blasting system, change the orifice and repressurize the system several times before the correct internal orifice size is established. Beside being tedious and time consuming, this orifice changing dictates that the operator have many sizes of internal orifices on hand. As a rule, the process of changing and matching the internal orifice to the blast nozzle results in considerable loss of the operator's time and down-time of equipment. This translates to a loss of revenue to the equipment owner.

U.S. Pat. No. 4,602,740 describes a fluid blast control apparatus, including a valve cartridge assembly for use with a single operator fluid blast gun. The valve cartridge assembly according to U.S. Pat. No. 4,602,740 is not effectively employed to adjust the pressure drop across the system because the tapered portion at the end of the valve closure member approaches the valve seat too rapidly for the desired range of adjustment of throttling pressure. Moreover, the valve closure member described in U.S. Pat. No. 4,602,740 was not designed to throttle high pressure fluids but rather to operate in either a full-open or a full-closed position. U.S. Pat. No. 4,602,740 describes a valve cartridge assembly in which the valve closure member is in a fully open position when the fluid blast gun is dumping fluid and in a fully closed position when the fluid is diverted through the high pressure nozzle.

It would therefore be advantageous to control the fluid flow and pressure in a high pressure blasting system wherein multiple blast guns are connected to a common blast pump with a fully adjustable type of control valve that does not require the installation of internal orifices and that also could be used in conjunction with common single-operator style dump guns. It would be further advantageous if the adjustment of such a control valve be made easily and externally without requiring difficult and dangerous wrench adjustments. It would be further advantageous if the control valve was of simple construction and the critical wear parts such as the adjustable valve and seat were packaged in cartridge form to facilitate quick and easy repair of the control valve in the field.

SUMMARY OF THE INVENTION

It is an object of the present invention to provide a multi-gun control valve which allows two or more common single-operator dump style fluid blast guns to be operated independently when connected to one fluid blast pump. In the present invention the multi-gun control valve divides the pump's total flow between the guns connected to the valve and maintains system pressure when either or all of the guns are dumping fluid.

It is a further object of the present invention to provide a control valve which may be adjusted easily by hand while the system is under pressure thereby eliminating the need for wrench adjustments and replacements of internal nozzles or orifices.

It is an object of the present invention to provide a multi-gun control valve for fluid blasting systems with a replacement valve cartridge assembly and pressure adjusting assembly. In the present invention the pressure adjusting assembly regulates the pressure drop across each valve cartridge assembly.

In the present invention the control valve throttles the pressure of the fluid to any valve which is in the dump mode (i.e., not in the blasting mode). The amount of pressure to be throttled depends on many system variables including but not limited to hose length and diameter, pump capacity and pressure, nozzle design and the number of blast guns to be operated on a common pump. These system variables cannot be accurately calculated or predicted, therefore it is preferable to have a means of field adjusting the pressure which each blast gun is subjected to while the blast system is operating.

In the present invention the adjustment means comprises an adjuster knob which can be rotated by means of manual force without the necessity of a wrench.

In the present invention the adjustment assembly can be manually rotated to adjust the pressure to be delivered to the blast gun connected to that assembly without depressurizing the system and without disassembly of the control valve.

Adjustment of the control valve disclosed herein is accomplished by opening the dump valve of the gun to be adjusted while simultaneously closing the dump valve on all other blast guns connected to the system. The control valve adjustment assembly is rotated to obtain the desired delivery pressure. Thereafter the other blast guns are adjusted in a similar manner. The control valve disclosed herein simplifies the adjustment of the pressure which each blast gun is to utilize. The adjustment assembly of each control valve allows for a pressure adjustment to be made independent of the hose length and size and nozzle selection.

In the present invention adjustment of the pressure drop across the control valve cartridge assembly is accomplished by rotating an adjuster knob to position a valve closure member relative to a valve seat. The adjuster knob is used to axially move a plunger which contacts the valve closure member and forces the valve closure member into a partially closed position.

It is an object of the present invention to provide a more efficient apparatus for regulating fluid pressure to a multiple gun fluid blasting system.

Another object of the present invention is to provide a manual adjusting mechanism which allows an operator to adjust the fluid pressure in a fluid blasting system without the necessity of an inordinate amount of physical force.

Another object of the present invention is to provide a valve cartridge assembly for fluid blasting equipment which is easily interchangeable without dismantling the entire valve control system.

Yet another object of the present invention is to provide a pressure adjusting mechanism for a multi-gun fluid blasting control system which may be easily adjusted while the system is pressurized.

Another object of the present invention is to provide an improved multi-gun control valve which automatically closes to create a back pressure in the system, when a gun is dumping, equal to the back-pressure of the blast nozzle in the operator's gun when his gun is blasting.

Still another object of the present invention is to provide an improved fluid blasting gun control valve which automatically opens to provide unrestricted flow when the operator's gun is blasting.

Still another object of the present invention is to provide an improved multi-gun control valve which makes it unnecessary to have identical nozzles and/or hoses for each gun connected to the valve as long as each gun control valve is adjusted properly for its gun's nozzle and hose.

Other objects and advantages will appear from the following specification. These objects, features and advantages of the present invention will become apparent with reference to the following detailed description of a preferred embodiment thereof in connection with the accompanying drawings wherein like reference numerals have been applied to like elements, these being indicative, however, of but a few of the various ways in which the principal of the invention may be employed.

BRIEF DESCRIPTION OF THE DRAWINGS

FIG. 3 is an elevational view partly in section of a multi-gun control valve for a single fluid blasting gun while that gun is in a dumping position.

FIG. 4 is an elevational view, partly in section of a multi-gun control valve for a single fluid blasting gun while that gun is in a blasting position.

FIG. 5 is an elevational view partly in section of a valve cartridge assembly detached from the multi-gun control valve assembly.

FIG. 6 is an elevational view partly in section of a control valve adjusting assembly detached from the multi-gun control valve assembly.

FIG. 7 is an elevational view partly in section of a valve guide housing detached from the multi-gun control valve assembly.

FIG. 8 is an elevational view of a valve closure member detached from the multi-gun control valve assembly.

Detail A adjacent FIG. 3 details the throttling position of the stem and stem housing.

Detail B adjacent FIG. 5 details the stem seal of the valve cartridge or stem housing.

DETAILED DESCRIPTION OF THE PREFERRED EMBODIMENTS

Figure 1:
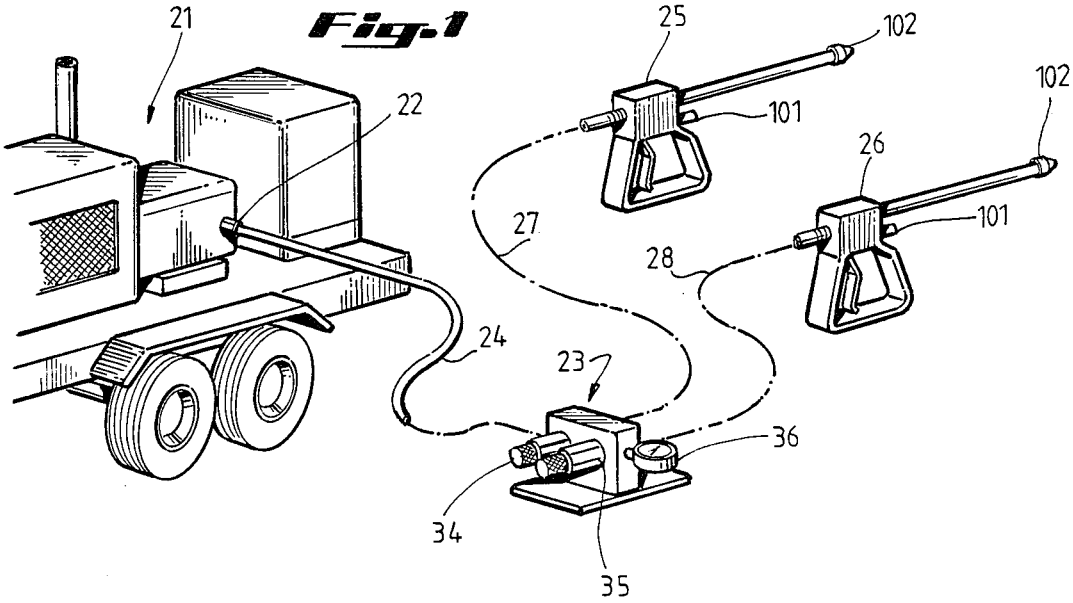
FIG. 1 is a schematic representation of a multi-gun blasting system and a multi-gun control valve.

Referring now in detail to the drawings and initially to FIG. 1, a trailer mounted high pressure pumping unit 21 is illustrated. As illustrated pumping unit 21 is engine driven (diesel or gasoline) however it is to be understood that this is not a limiting feature of the present invention.

The discharge 22 of pump unit 21 typically has a discharge of 10,000 p.s.i. However, pressures falling within the range of 2,000 p.s.i. to pressures in excess of 30,000 p.s.i. can be controlled by the present invention.

Figure 2:
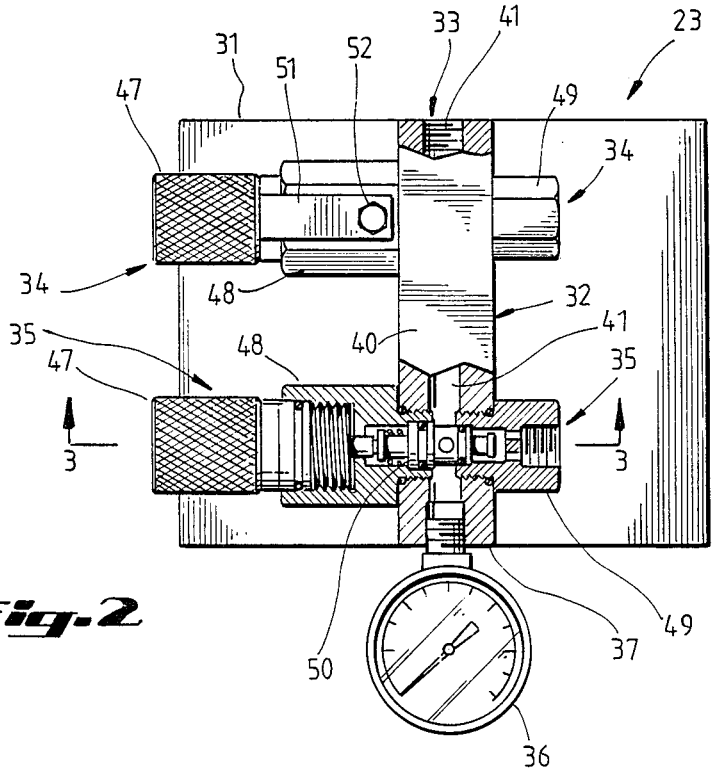
FIG. 2 is a top plan view of a multi-gun control valve serving two fluid blasting guns, with one valve partially cut away.

The discharge 22 of pump unit 21 is connected to the pressure control valve assembly 23 of the present invention by means of pump unit discharge hose 24. Pressure control valve assembly 23 is also illustrated in FIGS. 2, 3, and 4. The pressure control valve assembly 23 illustrated in FIGS. 1 and 2 is configured for two blasting guns 25 and 26. Blasting guns 25 and 26 are connected to pressure control valve assembly 23 by means of hoses 27 and 28. It will be apparent to one skilled in the art having the benefit of this disclosure that more than two blasting guns may be fed by pump 21 by merely modifying pressure control valve assembly 23 to accommodate additional pressure control valve assemblies in parallel.

Referring now to FIG. 2, a pressure control valve assembly 23 for two blasting guns is illustrated. The valve assembly 23 is comprised of a base 31, a manifold 32, inlet line port 33, pressure adjuster assembly 34 and 35. Also shown in FIG. 2 is an optional pressure gauge 36. In the event this gauge is not installed a plug may be installed in pressure gauge port 37.

In the preferred embodiment manifold 32 is installed onto base 31 by means of cap screws 38 (shown in FIGS. 3 and 4). Referring again to FIG. 2, manifold 32 consists of a rectangular member 40 with an internal cylindrical chamber or conduit 41 communicating the inlet port 33 with the pressure gauge port 37. The cylindrical chamber or conduit 41 is shown in FIGS. 3 and 4 as a dashed circle.

Crossing cylindrical chamber or conduit 41 are threaded ports 45 and 46 (see FIGS. 3 and 4). Matching threads on adjuster knob adapter and hose adapter are threads 45A and 46A respectively. Threaded ports 45 and 46 are illustrated in FIGS. 3 and 4 as having the same diameter and the same thread, however, it is to be understood that the configuration of the threaded ports may be varied to achieve a larger (or smaller) threaded port 45 with respect to threaded port 46. Threaded ports 45 and 46 are in communication with cylindrical chamber or conduit 41.

In the description which follows only one of the pressure adjuster assembly will be described. It is to be understood that pressure adjuster assemblies attached to manifold 32 are identical.

Referring again to FIGS. 2, 3 and 4, a pressure adjuster assembly consist of an adjusting knob 47, an adjustment knob adapter 48, a hose adapter 49, a pressure adjustment valve cartridge assembly 50, an adjuster lock arm 51 and an adjuster lock arm lockscrew 52.

Turning now to FIGS. 3 and 4 the pressure adjuster assembly 35 is illustrated in elevation in section. FIG. 3 illustrates the position of pressure adjustment valve cartridge assembly 50 in the position which produces the greatest pressure drop of the fluid entering inlet line port 33 consequently delivering fluid at hose attachment point 53 with the least amount of pressure.

FIG. 4 illustrates the position of pressure adjustment valve cartridge assembly 50 in the position which produces the least amount of pressure drop of the fluid entering inlet port 33 consequently delivering fluid at hose attachment point 53 with the least amount of pressure drop (i.e., approximately the inlet port pressure).

Referring again to FIG. 3 the adjusting knob has threads 55 which threadingly engage threads 56 in adjusting knob adapter 48. Adjusting knob adapter 48 also has an unthreaded cylindrical surface 57 which is used as a sealing surface as the adjustment knob O-ring 58 contacts cylindrical surface 57.

As illustrated in FIG. 6 adjustment knob 47 consists of an outer housing 59 with a concentric cylindrical bore 60. A concentric aperture 61 is located at one end of bore 60 with a threaded opening 61A located on the end opposite the aperture 61.

Cylindrical bore 60 slidingly receives a one-piece actuator 62 consisting of a positioning or actuating pin 63, stem 64 and flange 70C. Positioning or actuator pin 63 penetrates aperture 61 and bears on valve stem or valve closure member head 80. Actuator stem penetrates actuator retaining cap 65 at aperture 66 at the end opposite aperture 61. Retaining cap 65 is threadingly received by threaded opening 61A.

As illustrated in FIG. 6, retaining cap 65 has a concentric bore 66 which slidingly interengages stem 64. Cap 65 is retained in position by shoulder 67 and washer 67A on the inboard end and retaining ring 68 on the outboard end. Washer 67A acts as a bearing surface for disk springs 69. Also illustrated within the cylindrical bore 60 are belleville springs or disk springs 69 which are pre-loaded to approximately 500 lbs. Belleville springs 69 act against end cap 65 to push actuator 64 against stop 70 whenever no counter force is applied to pin 63 (see FIG. 3). In the event a counter force is applied to pin 63 (see FIG. 4) the belleville springs 69 compress. Additionally, actuator stem protrudes through retaining cap aperture 66 as the belleville springs 69 compress in response to any force greater than the spring preload force applied on the head of actuator pin 63. A pad 71 is placed at the terminus of actuator pin 63. Actuator pin 63, pad 71, stem 64, and flange 70C are preferably manufactured from 440C stainless steel quenched and tempered after machining. Pad 71 is provided to better define the contact point of pin 63 on head 80 of pin 81.

As illustrated in FIG. 6 flange 70C is an integral component of actuator 62. Belleville springs 69 are installed between flange surface 70B and washer 67A. Springs 69 are pre-loaded to approximately 500 lbs. This spring pre-load forces flange surface 70A to bear against actuator stop 70. Spring 69 may be compressed by any force of sufficient magnitude bearing against pin pad 71. The compression of spring 69 will be later described with respect to the operation of the control valve.

Since the spring force of spring 69 tends to push flange surface 70A against actuator stop 70 whenever the valve closure member 81 is throttling the pressure of the system, the displacement of pin 63 can be accurately and repeatably determined since the actuator 62 will consistently travel to a known point, i.e., actuator stop 70. Since adjuster knob 47 does not longitudinally move or rotate during normal system operation the amount of throttling, during dumping operations, does not vary since the actuator pin 63 acts on the closure stem 81 in a predictable, repeatable, and consistent manner. As the control valve cycles during operation of a blast gun from blasting mode to dumping mode, the actuator pin 63 returns the valve closure member 81 to its pre-set position, accurately and repeatably, since the displacement of stem 64 is controlled by causing the displacement to stop at the time flange surface 70A bears against stop 70. Control of the displacement of actuator pin 63 results in control of the displacement of closure member 81. By accurately controlling the displacement of closure member 81, the clearance between seat 94 and throttling seat station 97A can be accurately controlled. Consistently obtaining the same clearance between seat 94 and sealing surface 97A results in obtaining a control valve setting which consistently throttles the system to the pre-set setpoint.

Turning now to FIGS. 3 and 4 hose adapter 49 is threadingly engaged by means of male threads 46A interengaging threaded port 46. As previously indicated threaded port 46 is in communication with manifold cylindrical chamber 41. Interconnecting hose 27 (or 28) is threadingly engaged into thread 53 (or 54) by means of a suitable fitting adapted to the end of the hose. In this manner the blast gun 25 (or 26) is connected to the pressure adjuster assembly 34 (or 35).

As illustrated in FIGS. 3 and 4 hose adapter 49 has two internal annular bores 73 and 74 each a different diameter. The difference in diameters between bores 73 and 74 forms a shoulder 75 which acts as a stop for cartridge assembly 50.

In a similar manner adjusting knob adapter 48 has two annular bores 76 and 77 with different diameters. The different diameters of grooves 76 and 77 create a shoulder 78 which acts as a stop for valve cartridge assembly 50.

An additional reduced diameter bore 79 is concentric and has a smaller diameter than the diameter of the head 80 of seating pin 81. When Pin 81 is in the position tending to cause the last amount of pressure drop across the control valve, head 80 is resting against shoulder 79A.

Annular bores 74 and 76 are of slightly different diameters. Annular bores 74 and 76 snugly receive cartridge 50. Cartridge 50 is sealed within bores 74 and 76 by O-rings 82 and 83 respectively.

Turning to FIGS. 3 and 4, cylindrical bores 74 and 76 are of different diameters. The diameters of cylindrical bores 74 and 76 cooperatively match the outside diameters of O-rings 82 and 83 to provide a fluid seal while at the same time retaining a sliding fit of valve guide 50A with respect to cylindrical bores 74 and 76. The diameter of O-rings 82 and 83 correspond to the diameters of O-ring grooves **82*a* and 83*a*. By providing different diameters of cylindrical bores 74 and 76 and corresponding diameters on valve guide 50A**, the proper replacement of the valve assembly cartridge can be assured in that the cartridge can only be inserted in the proper orientation.

The larger diameter of cylindrical bore 76 with its corresponding O-ring 83 also produces accurate positioning of valve cartridge or guide 50A with respect to the bore shoulder or rib 78. The hydraulic forces acting on O-ring 83 are larger than the hydraulic forces acting on O-ring 82. The hydraulic forces on O-ring 83 are larger because the surface area on seal 83 is larger than the surface area of seal 82. Thus the hydraulic forces acting on seal 83 slidingly move cartridge 50A back against shoulder 78 whenever the control valve is under pressure.

This characteristic permits the cartridge to be accurately positioned against shoulder 78 without the need for expensive clamps and without the need for precision machining of bores 74 and 76.

Installation or replacement of cartridge 50 can be accomplished by removing hose adapter 49 and withdrawing cartridge 50, cartridge pin 81 and pin spring 84 from annular bores 76. A replacement cartridge 50 complete with pin 81 and pin spring 84 is thereafter inserted in annular bore 76 thereby engaging O-ring 83 within bore 76. Hose adapter 49 is thereafter interengaged in manifold body thread 46A thereby engaging O-ring 84 within groove 84A. Threaded engagement of hose adapter continues until face 32A of adapter 49 contacts face of manifold 32 at 0- ring 85. Cartridge assembly 50 is sealed by O-rings 82 and 83 in bores 74 and 76 respectively. Sealing of hose adapter is further provided by O-ring 85. The preferred embodiment of the hose adapter has a multitude of orifices 85A to diffuse high velocity water exiting from cartridge as the fluid exits the hose adapter into the hose.

In the alternative, adjuster adapter 48 may be removed to replace cartridge 50, pin 81 and pin spring 83. Sealing of cartridge 50 is accomplished in a similar manner as previously described. O-ring 86 provides additional sealing for adjuster adapter 48.

Referring now to FIGS. 3, 4 and 5 cartridge 50 is provided with a lip 87. Lip 87 serves as a handy pry point to remove cartridge but has no other functional use.

Referring again to FIG. 5, the preferred embodiment of adjuster cartridge assembly 50 is illustrated with pin 80 and pin spring 84. In the preferred embodiment, cartriage 50A of the cartridge assembly 50 has four orifices 88A, each located at 90° increments around the outer periphery of the cartridge body or housing 50A.

Cartridge body or housing 50A has a concentric bore 88. Concentric bore 88 has an annular groove 89 which retains pin O-ring 90 and teflon seal 90A. An additional annular groove 91 places orifices 82A in fluid communication with bore 88.

With pin 81 partially withdrawn from cartridge body or housing 50A bore 88 is in fluid communication with manifold cylindrical chamber 41 through orifices 88A. With pin 81 partially withdrawn (e.g., not sealed) fluid can be delivered from the inlet port 33 to the hose adapter 49 and subsequently to the hose and blast gun.

The valve cartridge assembly 50 comprises valve guide housing 50A and valve closure member or pin 81. The cartridge design of the valve guide housing 50A and throttling valve closure member 81 makes field replacement fast and simple. As can be seen more specifically in FIG. 7 and FIG. 8, the valve guide housing 50A is generally a tubular configuration having a leading end portion 91 at one end and intermediate portion 92 having a diameter smaller than the trailing end portion 93. The valve guide housing 50A has a housing bore 88 extending through the housing from the trailing end portion 93 to the intermediate portion 92 for slidably receiving a valve closure member or pin 81. The valve guide housing 50A has an annular throttling seat 94 within the housing bore 88. In the presently preferred embodiment of the invention, the angle of incline of the valve seat 94 is preferably about 20° to the longitudinal axis of valve guide housing 50A. The valve guide housing 50A has flow opening means in the form of flow openings or orifices 88A provided in an intermediate region of the housing 92. The leading end portion 91 includes a lip 87. The lip 87 enables the operator to quickly remove the valve cartridge assembly 50.

The valve closure member or pin 81 comprises a head portion 80; a spring centralizing portion 95; a polished intermediate cylindrical portion 96, on which teflon seal 90A slidingly contacts; A reduced diameter section 97; throttling seat section 97A and a leading cylindrical portion or nose 98 having a diameter smaller than the intermediate cylindrical portion 96. The leading cylindrical portion or nose 98 is provided to enter the throttling seat area 94 and thereby allow the operator to approach the desired back pressure or throttling pressure slowly as he is adjusting the control valve. The angle of tapered section 97A is preferably the same as the angle of the throttling valve seat 94, herein shown at about 20° . The valve closure member or pin 81 further includes bias means herein shown as a coil spring which urges the tapered section 97A of valve closure member 81 away from throttling valve seat 94. Bias means or spring 84 is provided on the valve or pin 81 to assist valve movement or bias away from seal 94 at low pressures. The force constant of valve closure member spring- 84 is significantly less than the force constant of belleville springs 69 in the adjusting knob 47.

When a gun is in a blasting mode, fluid pressure in the line between the blasting gun and the valve cartridge assembly 50 exerts pressure on the valve closure member face 99 and opens said valve closure member or pin 81. At this time, there is a minimal pressure drop across the valve assembly. When the valve is opened, the valve closure member or pin extends axially until it contacts shoulder 79A in the adjuster adapter 48.

When the gun is blasting, full pressure acts on the face 99 of valve closure member or pin 81. This force represented by arrow 100 (FIG. 8) is greater than the bias force exerted by spring 69 in the adjuster assembly 47. When the blaster gun is dumping, however, the bias force exerted by spring 69, in the adjuster assembly 47, is greater than the pressure force exerted on the face 99 of valve closure member 81. Therefore, the bias force exerted by spring 69, in the adjuster assembly 47, moves the plunger or pin 63 towards closure head 80 (e.g., left to right in FIG. 4) forcing the valve closure member or pin 81 in closer proximity with the valve seat 94 or to a partially closed or throttling position which has been previously preset by the operator. When the valve closure member or pin 81 is in a partially closed or in its throttling position, it creates a pressure drop across the valve seat in the zone identified as 97A (FIG. 8). When the adjuster assembly has been properly adjusted this pressure drop is equivalent to the pressure drop that would be experienced across an operator's gun nozzle when blasting.

Referring again to FIGS. 1 and 2, the control valve assembly is adjusted in the following manner: The system is connected as shown in FIG. 1. The blast gun 25 and 26 may be of the type described in U.S. Pat. No. 4,602,740, however, the only essential aspect of blast guns 25 and 26 is that they be equipped with a hand operated valve which dumps fluid out of a dump port such as 101 and that the blast gun divert the fluid from dump port 101 to the nozzle 102 when an operator chooses to begin blasting operations.

In the configuration shown by way of example only in FIG. 1 the pump 21 is started. The control valve assembly 23 is operated with adjusting knobs 47 backed out sufficiently to minimally contact head 80 of pin 81 thereby imposing no restriction in water flow to the blast guns. Both blast guns 25 and 26 are thereafter operated in the blast mode while the pump discharge pressure is adjusted by adjusting the rotational speed and volume of the driver and consequently the speed of the pump. Thereafter one operator continues blast operations, i.e., with gun 25 and the second operator is instructed to dump, i.e., with gun 26. In this configuration adjuster knob of pressure adjuster assembly 35 is manually rotated without the exertion of an inordinate amount of force and without the need of any mechanical lever or other mechanical assistance. Adjuster knob is rotated to produce a pressure drop across the throttling seat 97A of pin 81 and seat 94 of valve housing 50A, the pressure drop matching the pressure drop across the blast nozzle. This pressure drop is monitored by observing the pressure gauge on the discharge of the pump or the pressure gauge 36 on the manifold 32. Adjustment of adjustment knob 35 produces a throttled pressure of, in this example say 10,000 p.s.i. across the valve assembly 50.

In a similar manner pressure adjuster assembly 34 is adjusted by permitting gun 25 to dump while blasting with gun 26. In the event additional blast guns are connected through the use of a longer manifold with additional adjuster assemblies or the use of multiple control valve assemblies connected in parallel, adjustment is achieved by conducting blasting operations with all blast guns except for the gun which is being adjusted.

As a blast gun is dumping at low pressure, adjusting assembly 34 (or 35) is manually rotated toward valve cartridge assembly 50 thereby varying the clearance between seat 94 and stem area 97A and therefore creating a pressure drop across valve cartridge 50. The clearance between seat 94 and stem area 97A varies in direct relation to the longitudinal displacement of adjuster knob 47 of adjusting assembly 34 (or 35). Adjusting assembly 34 (or 35) acts as a relatively incompressible member since the pre-loaded force of spring 69 bearing against stem or flance face 70B (see FIG. 6) of actuator 62 causes flange face 70A to bear against face 70 of the actuator stop. The pre-loaded spring force of spring 69 is approximately twice the force necessary to move pin 81 towards seat 94 of cartridge housing 50A. During adjustment of the adjuster 34 (or 35) in the control gun dump mode, adjuster assembly 34 (or 35) acts as a solid member since pin 81 is not applying sufficient force on head 80 to compress spring 69. The operator rotates the adjuster assembly 34 or 35 to position seat 97A of valve closure member or pin 81 in close proximity with throttling valve seat 94 to create a pressure drop across the cartridge assembly 50 equivalent to the pressure drop across the operator's gun nozzle experienced when the gun is blasting.

In the throttling mode, the valve closure member or pin 81 is pressure biased to open or move toward and against adjusting assembly plunger or pin 63.

The pressure biasing is accomplished by providing a pressure seal area 90A (See FIG. 5 and Detail "B") around polished stem area 96 of pin 81, geometrically larger than the seating area of seat 97A of pin 81. The larger geometric area of seal 90A around stem area 96 hydraulically biases pin 81 towards pin 63 at all times that pressurized fluid is encountered in manifold 32.

Springs 69 provide an opposing force to valve closure member 81 greater than the pressure bias force applied to the valve closure member. This allows the adjusting assembly 34 or 35 to hold the valve closure member or pin 81 in a throttling position. The adjusting assembly plunger or pin 63 is used to accurately position the valve closure member 81 each time the gun is dumping to reach its desired throttling pressure. Adjuster lock arm or clamp 51 is used to lock the adjusting assembly knob 47 in the desired position when lock screw 52 is tightened.

Locking screw 52 threads into adapter thread 52*a* on adapter 49. To facilitate the installation of lock arm 51, adapter thread 52*a* is machined into each face of the hexagonal faces of adjusting knob adapter 48.

Additionally, bleed holes 52*b* are provided at the bottom of threaded holes 52*a* to insure chamber 77*a* is maintained at atmospheric pressure. The plurality of holes (i.e., 6 in the hexagonal adapter exterior) also provides a pressure venting means in the event seal 90A fails and fills chamber 77*a* with fluid. Bleed holes 52*b* also minimize the potential for a bursting failure of adapter 48.

Bleed holes 52*b* also serve as a tell-tale warning means in the event seal 90A begins to leak.

Since each blast gun can be adjusted independently it is not necessary to have identical nozzles and/or hoses (length or diameter) in each of the guns connected to the multi-gun control valve. After each gun control valve is adjusted properly, the amount of back pressure created by the gun control valve will maintain system pressure when either or all of the guns are dumping.

FIG. 4 indicates the position of the control valve cartridge and adjuster assembly and valve closure member or pin when the valve closure member or pin is in an open position while an operator's gun is blasting. Substantially no pressure drop occurs across the valve cartridge 50 when the gun operating is in the blasting mode.

Referring to FIGS. 1 and 4, when the operator closes the blasting gun valve (i.e., quits dumping), pressure builds up in the line 27 (or 28) between the gun 25 (or 26) and the multi-gun control valve assembly 34 (or 35). This pressure acts on the face 99 of the valve closure member or pin 81 and creates a force to open the valve closure member or pin 81 greater than the bias force of spring 69 in the adjusting assembly 34 (or 35). Once the valve closure member or pin 81 starts moving away from throttling valve seat 94, pressure acts on the full sealing diameter area of seal 90A causing the valve closure member or pin 81 to move quickly into its full open position shown in FIG. 4. Movement of the valve closure member is stopped by shoulder 79A provided in the adjuster adapter 48. With the valve closure member or pin 81 in a fully open position, high pressure fluid freely flows through the multi-gun control valve and provides full blasting pressure to the operator's gun nozzle.

In a similar manner when blasting operations are discontinued (i.e., dumping mode) the flow restriction at nozzle 102 of gun 25 (or 26) is no longer realized by the system. When dumping is commenced fluid flows out of dump port 101. As fluid flows out of unrestricted dump port 101, the pressure in hose 27 (or 28) collapses. As the pressure in the hose collapses the force acting on seal 90A and face 99 of valve pin 81 is substantially reduced thereby permitting the biasing force of spring 69 to urge the valve pin 81 towards valve seat 94 in cartridge assembly 50. Travel of pin 81 continues until such time as flange face 70A of stem 64 contacts actuator stop surface 70 of adjusting knob 47. This accurately and repeatably positions seat 97A of pin 81 with respect to seat 94 of the valve cartridge housing 50A to its preset throttling position. This results in the pressure drop, previously occurring at nozzle 102, to occur at cartridge assembly 50. The pressure is continuously reduced at cartridge assembly 50 until blasting operations are again commenced.

The operation of assembly 35 is transparent to assembly 34 and vice versa. This permits the operator of gun 25 to operate his gun in either the dump or blast mode without affecting the operation of gun 26. In a similar manner gun 26 can be operated in either dump or blast mode without affecting the operation of gun 25. It is important for gun 25 and 26 to operate independently and transparently in order to avoid a recoil in one gun occasioned by the change from blast to dump mode (or vice versa) by another gun. The use of a multi-gun control valve 23 permits one operator to continue blasting even though another operator has ceased blasting since control valve 23 maintains system pressure. In the event control valve 23 were not installed the commencement of dumping operations by any operator collapsed the system pressure and renders all other blast guns inoperative.

It now will be recognized that a new and improved multi-gun control valve has been disclosed. Since certain changes or modifications may be made in the disclosed embodiments without departing from the inventive concepts disclosed herein by those skilled in the art having the benefit of this disclosure. It is the intent to cover those modifications by the appended claims and the equivalents thereof.

What I claim is:

1. In a hydraulic blast system including a source of high pressure liquid and a blast gun operative in a first condition to discharge liquid at relatively high pressure through a blast nozzle and in a second condition to dump liquid at a relatively low pressure through a dump port, a control valve comprising:

a valve housing having a passageway including an inlet adapted to receive high pressure liquid from said source and an outlet adapted to deliver liquid to said blast gun;

a valve seat in said passageway;

a valve closure member movably mounted in said valve housing to move between a first limiting position approaching said valve seat to provide a pressure drop across said valve seat, and a second limiting position clear of said valve seat; and adjustment means attached to the valve housing to adjust he first limiting position of the valve closure member.

2. The system of claim 1 wherein the adjustment means includes a spring biased to move the valve member toward the valve seat.

3. The system of claim 2 wherein the area of the valve member exposed to hydraulic pressure in the valve housing is sufficient to generate a force greater than and opposing the force of the spring when the blast gun is in said first condition and a force less than and opposing the force of the spring when the blast gun is in said second condition.

4. The system of claim 3 further comprising a lock mounted in the adjustment means operable to set the position of the adjustment means relative to the valve closure member.

5. In a hydraulic blast system including a source of high pressure liquid and a blast gun operative in a first condition to discharge liquid at relatively high pressure through a blast nozzle and in a second condition to dump liquid at relatively low pressure through a dump port, a control valve comprising:

(a) a valve housing having a first passageway extending axially through the valve housing and terminating at a first outlet end in an outlet adapted to deliver liquid to the blast gun, a second opposite end, and a side inlet adapted to receive high pressure liquid from said source;

(b) a valve cartridge assemble insertable within said first passageway and comprising:

(1) a valve cartridge housing having a second passageway co-axial with the valve housing passageway, an outlet at one end of said second passageway, a side port communicating with the side inlet of the valve housing, and an annular valve seat in said second passageway between said side port and the outlet end of the second passageway and facing away from said outlet end; and, (2) a valve closure member including a valve seat adapted to seat on the annular valve seat, and a valve stem extending away from said outlet end and movably fitted within said second passageway between said side inlet and the end of said second passageway away from said outlet end;

(c) an adjuster assembly attachable to the second end of said valve housing away from said outlet end of said valve housing and comprising:

(1) a generally cylindrical body member having an axially disposed chamber and adapted at a first end to be attached to said second end of said housing, (2) a plunger within said chamber in axially movable relation with said chamber and extending at a first end through said first end of said chamber to contact the end of said valve stem; and, (3) a compression spring in said chamber arranged and biased to force said plunger toward said first end and apply force against the end of the valve stem.

6. The hydraulic blast system of claim 5 further comprising a stop within said chamber to limit movement of said plunger toward said valve stem.

7. The hydraulic blast system of claim 6 wherein said adjuster assembly is movably attached to said valve housing to move axially relative to the valve housing.

8. In a hydraulic blast system including a source of high pressure liquid and a blast gun operative in a first condition to discharge liquid at a relatively high pressure through a blast nozzle and in a second condition to dump liquid at a relatively low pressure through a dump port, a control valve comprising:

(a) a housing having an outlet end adapted to deliver liquid to said blast gun and a side inlet adapted to receive liquid from said source;

(b) a valve assembly insertable within said housing through said outlet end to engage said housing in peripherally sealed relation, said valve assembly comprising:

(1) a valve housing having a side port communicating with said side inlet, a passageway communicating between said side port and said outlet end, and a valve seat in said passageway facing away from said outlet end;

(2) a valve closure member movable within said valve housing between a first position approaching said valve seat and a second limited position away from said valve seat;

(c) a closure member attachable to said outlet end to hold said valve assembly within said housing;

(d) a spring loaded member operative through said housing end biased to force said valve closure member toward said valve seat;

(e) said valve closure member having an area within said housing configured to apply a first force responsive to pressure at said outlet end when said blast gun is in said first condition which exceeds the force applied by said spring loaded member, and a second force responsive to pressure at said outlet end when said blast gun is in said second condition which is less than the force applied by said spring loaded member.

9. The system of claim 8 wherein the position of the spring loaded member is adjustable relative to the valve seat.

* * * * *